US005961425A

United States Patent [19]

Reid et al.

[11] Patent Number: 5,961,425

[45] Date of Patent: Oct. 5, 1999

[54] JUMP ROPE DEVICE

[75] Inventors: Tahira Reid; Andrew Burdick, both of Troy, N.Y.

[73] Assignee: Rensselaer Polytechnic Institute, Troy, N.Y.

[21] Appl. No.: 09/041,584

[22] Filed: Mar. 12, 1998

[51] Int. Cl.[6] ..... A63B 5/20

[52] U.S. Cl. ..... 482/81; 482/82

[58] Field of Search ..... 482/81, 82

[56] References Cited

U.S. PATENT DOCUMENTS

| | | | |
|---|---|---|---|
| 1,893,173 | 1/1933 | Kreutzer | 482/82 |
| 3,107,092 | 10/1963 | Morris et al. | 482/82 |
| 3,610,616 | 10/1971 | Evans | 482/81 |
| 4,082,266 | 4/1978 | Elkins | 482/81 |
| 4,529,195 | 7/1985 | Stevens | 482/81 |
| 5,620,402 | 4/1997 | Simonson | 482/72 |

*Primary Examiner*—Jerome Donnelly
*Attorney, Agent, or Firm*—McAulay Nissan Goldberg Kiel & Hand LLP

[57] ABSTRACT

The jump rope device is constructed with a pair of stations disposed in mirror-image facing relation and a pair of ropes which are connected between rotating arms of each station. Each station employs a stepper motor to rotate the radially disposed arms as well as a transmission for rotating the arms in an out-of-phase relation to create a double dutch effect. The end of each rope is secured to a cord which is wound about a rotatable drum within each radial arm so that the length of exposed rope may be adjusted to a user. Should a user step on a rope, the resulting tension in the rope and cord effects an unwinding of the cord from the drum thereby allowing the rope to break away from the arm of the station.

14 Claims, 4 Drawing Sheets

JUMP ROPE DEVICE

This invention relates to a jump rope device. More particularly, this invention relates to a jump rope device employing a pair of jump ropes to create a double dutch effect.

Heretofore, various types of devices have been provided for turning jump ropes. In some instances, the devices have been constructed to swing a pair of jump ropes in an out-of-phase manner to create a double dutch effect. As described in U.S. Pat. No. 4,529,195, such a device employs a driving station having driving means and a pair of radial arms to which the ends of a pair of ropes are secured for swinging in opposite directions as well as a driven station having a pair of rotatable arms to receive the opposite ends of the ropes. As described, the driving station and the driven station are connected only by the ropes.

Still other machines have been known for swinging a pair of ropes wherein synchronized drive means have been provided for turning the ropes in an out-of-phase relation. However, such devices have been relatively cumbersome and have been difficult to adjust should the ropes become unsynchronized.

In cases where a driving station drives a driven station through the ropes, there can be a time lag between the two stations so that the synchronization of the two stations is impaired. In addition, drag forces can be introduced into the driven station so that the ropes may become unsynchronized during use.

Accordingly, it is an object of this invention to provide a relatively simple jump rope device for turning a pair of ropes in an out-of-phase relation in a simple synchronized manner.

It is another object of the invention to provide a jump rope device for creating a double dutch effect with little risk of the ropes becoming unsynchronized.

It is another object of the invention to be able to stop a jump rope device should a rope become stepped on by a user or otherwise engaged.

Briefly, the invention provides a jump rope device which comprises a pair of stations disposed in mirror-image facing relation to each other and a pair of ropes.

In accordance with the invention, each station has a pair of parallel rotatable shafts, a transmission connecting the shafts together to rotate in opposite directions, a stepper motor operatively connected to one of the shafts to rotate the shaft and a pair of arms, each of which is connected to and extends radially from a respective shaft to rotate therewith. The stepper motor of each station is synchronized to the stepper motor of the opposite station so that the oppositely-facing radially directed arms rotate in synchronism with each other at all times.

Each rope is secured at the opposite ends to opposed arms of the two stations in order to rotate with the arms whereby rotation of the ropes in an out-of-phase relation creates a double dutch effect for a jumper.

The transmission of each station includes a pair of pulley wheels, each of which is mounted on a respective shaft, and a belt disposed over and across the pulley wheels in criss-crossing relation. In addition, the stepper motor utilizes a belt and pulley arrangement for driving one of the shafts so that this shaft acts as a master while the other shaft functions as a slave.

Each arm of each station has a tubular portion receiving an end of a respective rope in axially slidable relation. In addition, a rotatable drum is disposed transversely of at least one of the arms and a cord is secured to and between one end of a respective rope and the drum. A crank arm located to the outside of the arm is also connected to the drum so that the end of the rope can be adjustably movable within the arm in response to winding of the cord on the drum. In this way, the length of each rope may be adjusted to the height of an individual jumper.

A release means is also provided for releasably locking the crank arm in a fixed non-rotatable position and for releasing the crank arm to allow the drum to rotate in response to a predetermined tension in the cord corresponding to a pulling force on one end of the rope secured to the cord. Thus, during normal operation, the release means serves to lock the crank arm and drum and thereby the end of the rope in the tubular portion of a rotating arm. In the event that a jumper steps on a rope, the rope, in turn, pulls on the cord. Once the tension in the pulled cord exceeds a predetermined limit, the crank arm is released and the drum allowed to rotate so that the cord allows the rope to extend away from the arm. In an extreme case, the cord may unwind from the drum so that the rope becomes completely disengaged from the drum thereby breaking the connection between the rope and each respective station.

The release means may include a magnet which is mounted on an arm while the crank arm is magnetically attracted to the magnet. Thus, in a non-rotatable position of the drum, the crank arm is aligned with the magnet and remains in place. Should the cord become tensioned, the crank arm moves away from the magnet into the released condition.

The jump rope device may be provided with a suitable signal means for indicating a position of at least one of the arms at a predetermined position of rotation. Depending upon the position of the signal means, the jumper may use the signal to enter between the rotating ropes to effect a double dutch jump or may use the signal means as a signal to begin approaching the device. In one embodiment, the signal means includes a metal strip which is mounted on one of the shafts, a circuit having a normally open switch in the path of rotation of the metal strip and an indicator light, such as an LED, whereby the light is energized in response to the metal strip closing the switch at the position corresponding to the predetermined position of rotation.

Each station of the jump rope device is mounted on a plurality of support wheels which rollably support the stations in order to permit movement of one station relative to another. Thus, depending upon the height of a jumper, the stations may be brought closer together or moved farther apart. Also, when not in use, the stations may be brought together and moved to a position of storage.

These and other objects and advantages of the invention will become more apparent from the following detailed description taken in conjunction with the accompanying drawings wherein.

Figure 1:
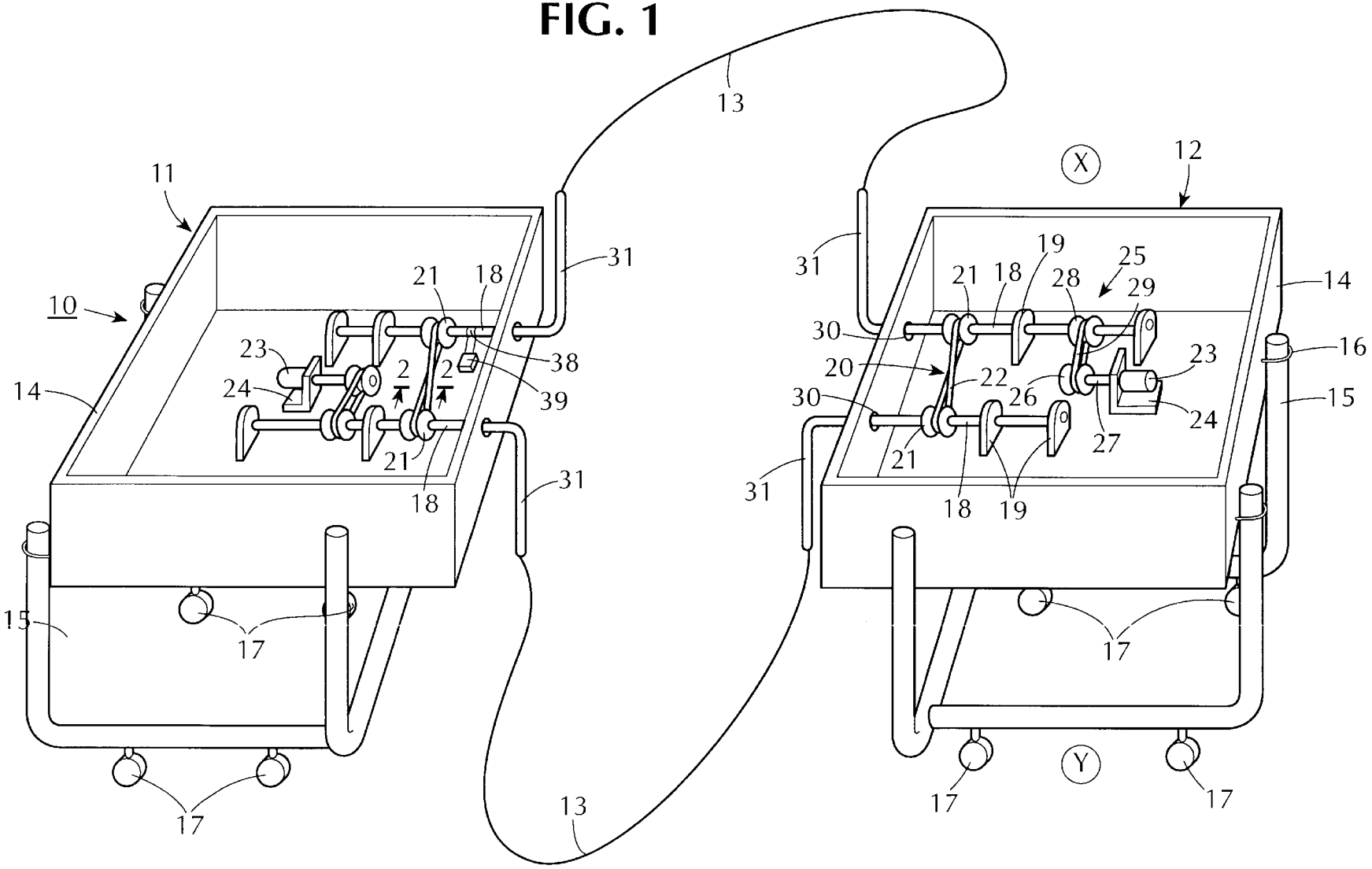
FIG. 1 illustrates a perspective view of a jump rope device constructed in accordance with the invention.

Referring to FIG. 1, the jump rope device 10 employs a pair of stations 11, 12 disposed in mirror-image facing relation to each other as well as a pair of ropes 13 which are connected between the stations 11, 12. Since each station 11, 12 is constructed in an identical fashion so that a description of one station is sufficient for both.

Figure 5:
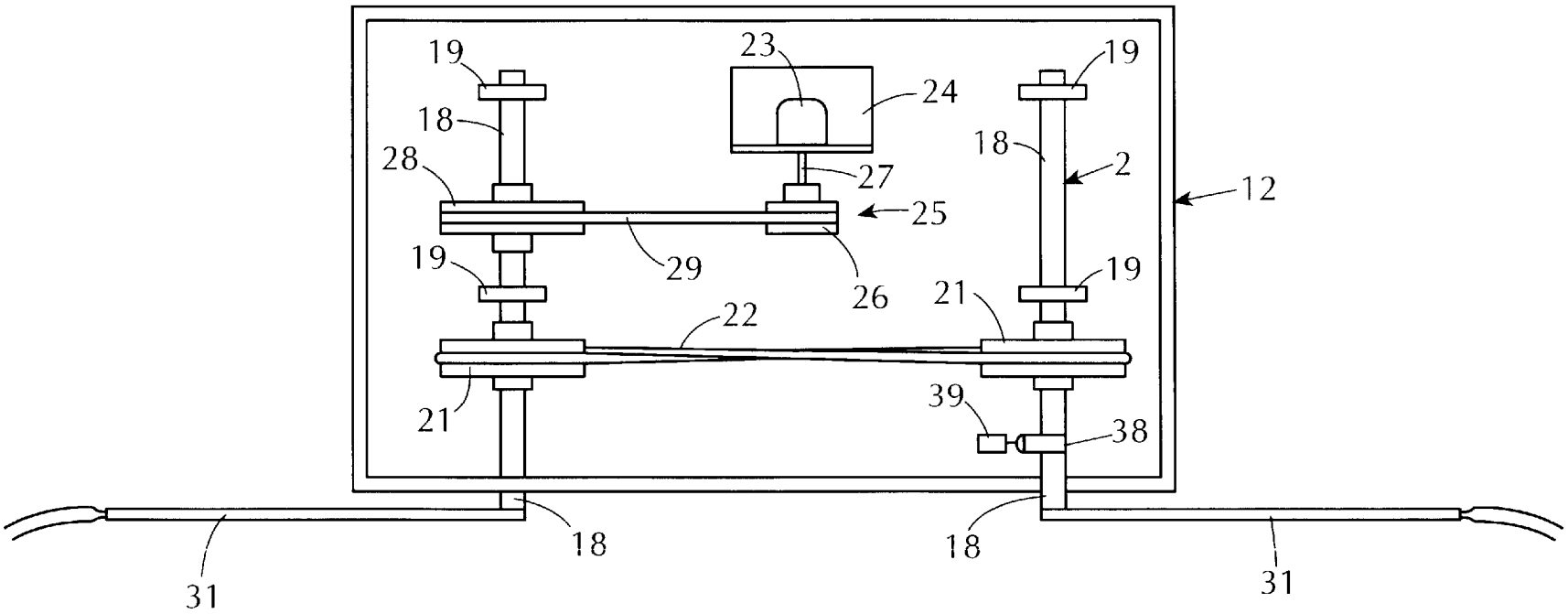
FIG. 5 illustrates a top view of one of the stations of the jump rope device in accordance with the invention.

Referring to FIGS. 1 and 5, the right-hand station 12 has a box-shaped housing 14 which is mounted on a skeletal frame 15, for example composed of tubular members. As indicated, suitable clips or clamps 16 are provided to secure the housing 14 to the skeletal frame 15. In addition, the frame 15 is provided with casters or wheels 17 at four points so as to permit the station 12 to be rolled from place to place.

Figure 2:
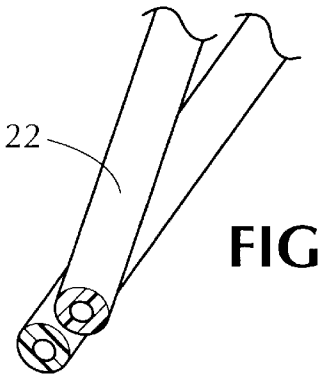
FIG. 2 illustrates a view taken on line 2—2 of FIG. 1 of a criss-crossing belt of a transmission.

The housing 14 includes a pair of parallel rotatable shafts 18 each of which is mounted in a pair of brackets 19 secured to a floor of the housing 14. In this respect, each bracket 19 includes a suitable bearing to permit easy rotation of the respective shafts 18. A transmission 20 is also provided to connect the shafts 18 together to rotate in opposite directions. This transmission 20 includes a pulley wheel 21 secured to each shaft 18 and a belt 22 which is disposed over and across the pulley wheels 21 in criss-crossing relation. As indicated in FIG. 2, the two runs of the belt 22 come into contact at a crossing point and, to this end, are made of a suitable non-abrasive material to avoid excessive wear. Alternatively, the transmission may be a geared transmission using gears (not shown) to transfer the drive forces.

A stepper motor 23, such as a superior electric MO62-LE09, is mounted on a suitable bracket 24 within the housing 14 and is operatively connected via a transmission 25 to one of the shafts 18 to rotate the shaft 18, for example in a clockwise manner. As indicated, the transmission 25 includes a pulley wheel 26 mounted on a drive shaft 27 of the motor 23, a pulley wheel 28 mounted on the shaft 18 and a belt 29 disposed over and between the pulley wheels 27, 28.

Upon actuation of the motor 23, one shaft 18 is driven in a clockwise manner while the second shaft 18 is driven via the transmission 20 in a counter-clockwise manner. Alternatively, the rotation of the shafts may be effected in opposite directions depending upon the direction of the drive shaft 27 of the motor 23.

As illustrated, each shaft 18 passes through a suitable opening 30 in the housing 14 and carries a radially directed arm 31 at the free end. Each arm 31 is connected to and extends radially from a respective shaft 18 to rotate therewith. As indicated in FIG. 1, each respective rope 13 is secured at the opposite ends to opposed arms 31 of the stations 11, 12 to rotate therewith whereby rotation of the ropes 13 in an out-of-phase relation creates a double dutch effect for a jumper.

Figure 4:
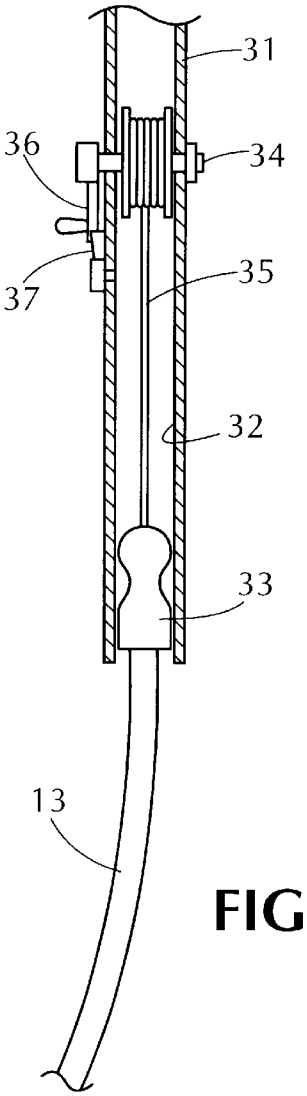
FIG. 4 illustrates a perspective view of a drum and cord arrangement for securing one end of a rope in a rotating arm in accordance with the invention.

Referring to FIG. 4, each arm 31 has a tubular portion 32 receiving an end of a rope 13 in axially slidable relation. As indicated, the end of the rope 13 may be provided with a cap 33, a molded cover, a handle or any other suitable means fixed to the rope 13. A drum 34 is disposed transversely of the arm 31 while a cord 35 is secured to and between the end of the rope 13 and the drum 34 whereby the end of the rope 13 can be adjustably moved within the arm 31 in response to winding of the cord 35 on the drum 34. As shown, the drum 34 is connected to a crank arm 36 located to the outside of the arm 31 for manually winding of the drum 34.

A release means 37 is also provided for releasably locking the drum 34 in a fixed non-rotatable position and for releasing the drum 34 to rotate in response to a predetermined tension in the cord 35 corresponding to a pulling force on the end of the rope 13. In this embodiment, the release means 37 is in the form of a magnet while the crank arm 36 is made of a material to be magnetically attracted to the magnet 37. The magnetic force generated by the magnet 37 is sufficient to hold the crank arm 36 from turning up to a limit of predetermined tension in the cord 35.

Figure 3:
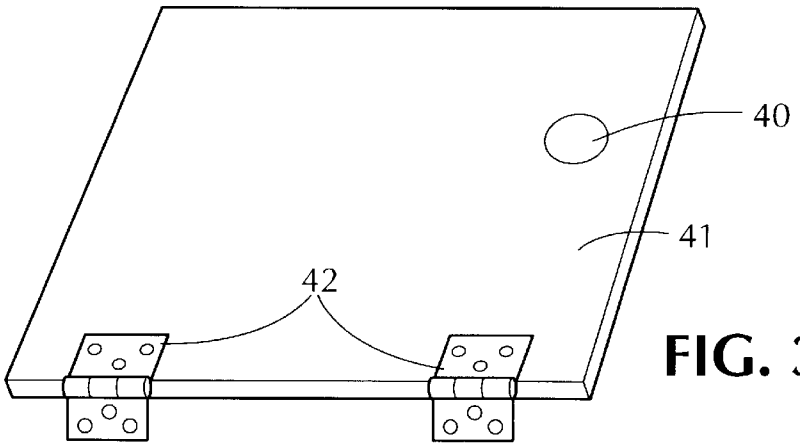
FIG. 3 illustrates a perspective view of an indicator light mounted on one of the stations of the jump rope device.

Referring to FIGS. 3 and 5, the jump rope device 10 is also provided with a signal means for indicating a position of one of the arms 31 at a predetermined position of rotation. This signal means includes a metal strip 38 which is mounted on one of the shafts 18 to rotate therewith, a circuit having a normally open switch 39 in the path of rotation of the metal strip 3 8 and an indicator light 40 (see FIG. 3) mounted on a cover 41 which is hingedly secured to the top of the housing 14 (not shown) by a pair of hinges 42. The arrangement is such that the light 40 is energized in response to the metal strip 38 closing the switch 39 at a position corresponding to the predetermined position of rotation of the arm 31 secured to the shaft 18.

Referring to FIG. 1, as described above, the two stations 11, 12 are exactly alike except that one station would contain all the circuitry for operating the device 10 and the indicator light 40 (not shown) that would signal a jumper when to jump. The arms 31 of each station are disposed to rotate 180° out-of-phase with respect to each other to simulate a perfect human motion. The ropes 13 which rotate with the opposed arms 31 create a double dutch effect. For example, one rope 13 forms a sine wave while the other rope 13 forms a negative sine wave during operation.

Figure 6:
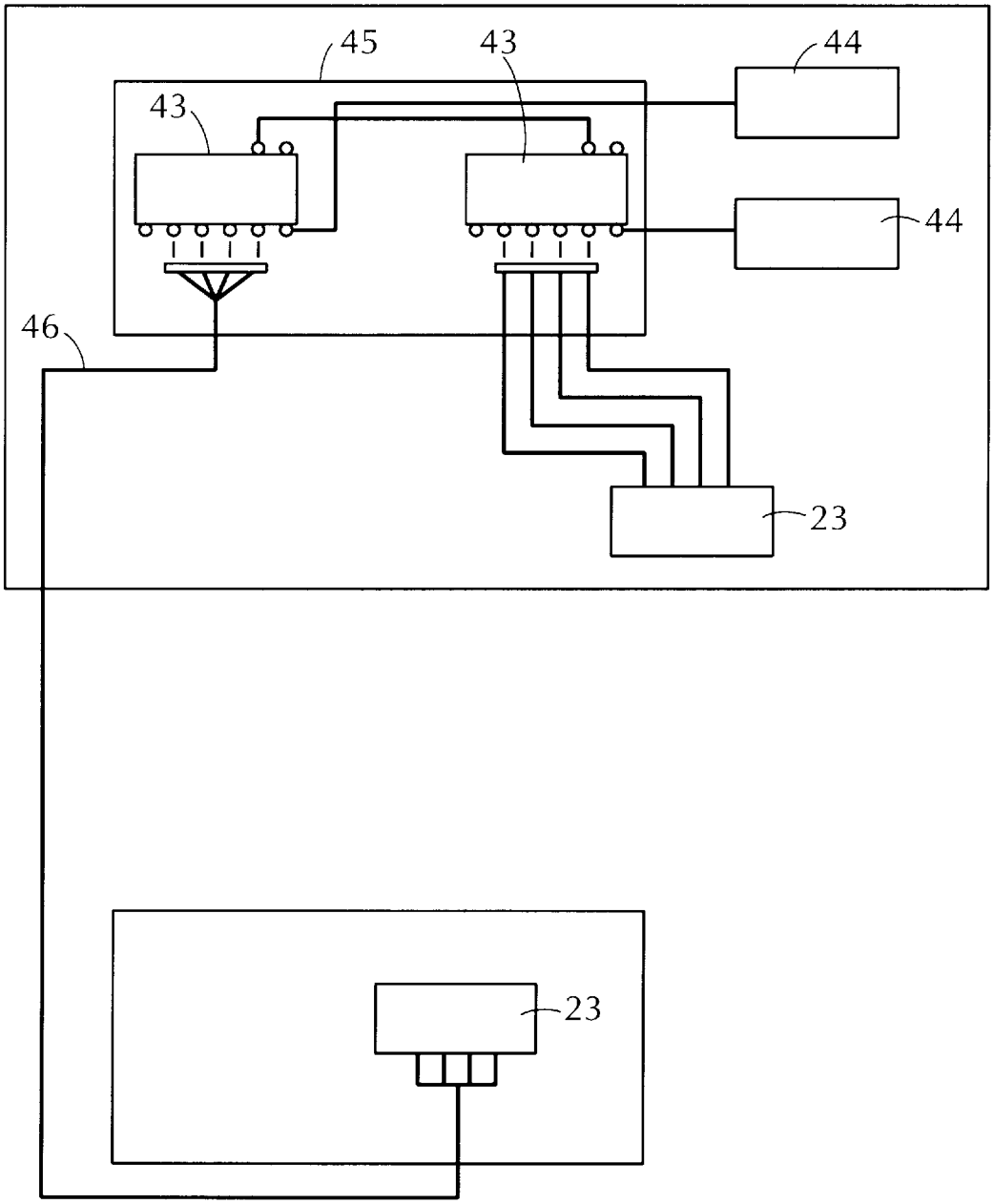
FIG. 6 illustrates a schematic view of the drive circuit for the device.

Referring to FIG.6, in order to synchronize operation of the two stepper motors 23, use is made of a Superior Slo-Syn® BiPolar Model SD200 Step Motor Drive Module 43 to drive each motor 23 with each Drive Module 43 being supplied with power from a battery44. Each Module 43 has pins, as is known, with one pin each being conncted by a common wire 45 to each other to effect synchronization. A wire 46 connecting one Module 43 to the remote station 14 can be held out of interferring with the jump ropes 13 by being taped or otherwise secured along the ground away from the user.

The jump rope device is programmed, for example so that when a radial arm 31 reaches approximately 45° to the horizontal, the metal strip 38 mounted on the associated shaft 18 contacts the normally open switch 39 which will then close the circuit to light the indicator light 40 (for example a light emitting diode). The light 40 will be energized and illuminate each time the radial arm 31 reaches the 45° position so that a person may enter the rope from the location marked X in FIG. 1. Of note, this position may be marked by suitable indicia (not shown) on the face of the housing 14. For jumpers that feel comfortable entering the ropes from the opposite side, for example from the position marked Y, entry may be made after the indicator light 14 has been illuminated for a short time period. This will require the jumper to develop some delayed action time for entering the ropes at either end.

Once a jumping exercise has been initiated, should a jumper step on a rope, the release means incorporated in each radial arm 31 of the device effects a breakaway effect. During regular operation, the ropes 13 will remain secured within the ends of the arms 31 while, at the same time, being allowed to swivel around within the radial arms 31. Once the force of a jumper's foot adds the minimum required tension to a cord 35, that is to say, a force stronger than the force of the magnet 37 (see FIG. 4), the drum 34 will permit the cord 35 to unwind thereby releasing the cord 35, thus allowing the rope 13 to fall to the ground. The user will then have to rewind the cord 35 on the drum 34 using the crank arm 36 until a designated mark (not shown) on the rope 13 comes into alignment with the free end of the radial arm 31. This characteristic may also be used to adjust the length of the rope 13 for persons of different heights.

The jump rope device may be controlled in a remote manner. In this respect, a suitable remote control may be provided which is constructed to start up, shut down and adjust the speed of the jump rope device.

The jump rope device may be readily used by a jumper. In this respect, a jumper may enter the ropes from the side that the jumper feels the most comfortable for entering purposes. Once within the ropes, the jumper would alternate the lifting of each leg in a running-like motion in order to allow each rope to pass under his/her feet. The jumper may also hold onto a hand remote control during jumping in order to adjust the speed as desired. When ready to end a jumping session, the jumper need only press the appropriate key on the remote control to stop the device from turning the ropes 13 or manually interrupt the rotation of the ropes.

The jump rope device may also be activated by using a push button start up, particularly for jumpers who have manual deficiencies and do not wish to use a remote control feature. In some cases, a second person may be required as a controller in order to control the speed of the device. Further, a foot pad controller may be incorporated so that a manually challenged individual may have sole control of the device.

The housing 14 of jump rope device 10 may be separately mounted on the frame 15 for example so that the frame 15 can be fixed in place such as in a playground and the housing 14 removed when not in use and placed in storage for future use. Any suitable arrangement or means may be used to secure the housing 14 to the frame 15 in a releasably lockable manner.

The invention thus provides a jump rope device which is of relatively simple construction and which can be readily used. The jump rope device may be used as a warm-up device for professional teams, a cardio-vascular workout machine for fitness users, and for use in recreational centers, parks, jump rope camps and the like. The device may also be equipped for both DC and AC capabilities so as to be used outdoors and/or indoors.

What is claimed is:

1. A jump rope device comprising a pair of stations disposed in mirror-image facing relation to each other, each station having a pair of parallel rotatable shafts, a transmission connecting said pair of shafts together to rotate in opposite directions, a stepper motor operatively connected to one of said shafts to rotate said one shaft and a pair of arms, each arm being connected to and extending radially from a respective one of said pair of shafts to rotate therewith; and a pair of ropes, each rope being secured at opposite ends to opposed arms of said stations to rotate therewith whereby rotation of said ropes is an out-of-phase relation creates a double dutch effect for a jumper.

2. A jump rope device as set forth in claim 1 wherein said transmission of each respective station includes a pair of pulley wheels, each wheel being mounted on a respective one of said pair of shafts, and a belt disposed over and across said pair of pulley wheels.

3. A jump rope device as set forth in claim 1 wherein each arm has a tubular portion receiving one end of a respective rope in axially slidable relation.

4. A jump rope device as set forth in claim 3 which further comprises a drum disposed transversely of at least one of said arms and a cord secured to and between one end of a respective rope and said drum whereby said one end of a respective rope is adjustably movable within said one arm in response to winding of said cord on said drum.

5. A jump rope device as set forth in claim 4 which further comprises a release means for releasably locking said drum in a fixed non-rotatable position and for releasing said drum to rotate in response to a predetermined tension in said cord corresponding to a pulling force on said one end of said respective rope.

6. A jump rope device as set forth in claim 5 wherein said release means is a magnet mounted on said respective one of said arms and said drum is connected to a crank arm magnetically attracted to said magnet.

7. A jump rope device as set forth in claim 1 which further comprises a signal means for indicating a position of one of said arms at a predetermined position of rotation.

8. A jump rope device as set forth in claim 7 wherein said signal means includes a metal strip mounted on said shaft connected to said one arm, a circuit having a normally open switch in a path of rotation of said metal strip and an indicator light whereby said light is energized in response to said metal strip closing said switch at a position corresponding to said predetermined position of rotation.

9. A jump rope device as set forth in claim 1 wherein each station has a plurality of support wheels for rollably supporting said respective station to permit movement of one station relative to the other station.

10. A jump rope device comprising at least one station having a pair of parallel rotatable shafts, a transmission connecting said pair of shafts together to rotate in opposite directions, a stepper motor operatively connected to one of said shafts to rotate said one shaft and a pair of arms, each arm being connected to and extending radially from a respective one of said pair of shafts to rotate therewith; and a pair of ropes, each rope being secured at one end to a respective one of said arms.

11. A jump rope device as set forth in claim 10 wherein each arm has a tubular portion receiving one end of a respective rope in axially slidable relation.

12. A jump rope device as set forth in claim 11 which further comprises a drum disposed transversely of at least one of said arms and a cord secured to and between one end of a respective rope and said drum whereby said one end of a respective rope is adjustably movable within said one arm in response to winding of said cord on said drum.

13. A jump rope device as set forth in claim 12 which further comprises a release means for releasably locking said drum in a fixed non-rotatable position and for releasing said drum to rotate in response to a predetermined tension in said cord corresponding to a pulling force on said one end of said respective rope.

14. A jump rope device as set forth in claim 13 wherein said release means is a magnet mounted on said respective one of said arms and said crank is connected to a crank arm magnetically attracted to said magnet.

* * * * *